US005359865A

United States Patent [19]

So

[11] Patent Number: 5,359,865

[45] Date of Patent: Nov. 1, 1994

[54] INTERLOCK KNITTING MACHINE FOR JACQUARD KNITTING

[75] Inventor: Hidetoshi So, Kobe, Japan

[73] Assignee: Precision Fukuhara Works, Ltd., Japan

[21] Appl. No.: 128,603

[22] Filed: Sep. 29, 1993

[30] Foreign Application Priority Data

Oct. 9, 1992 [JP] Japan ..... 4-297977

[51] Int. Cl.[5] ..... D04B 15/68

[52] U.S. Cl. ..... 66/19; 66/220

[58] Field of Search ..... 66/19, 20, 38, 218, 66/219, 220, 222, 223

[56] References Cited

U.S. PATENT DOCUMENTS

| | | | |
|---|---|---|---|
| 2,262,213 | 11/1941 | Tamdler | 66/219 X |
| 3,967,468 | 7/1976 | Christopoulos | 66/20 |
| 4,038,837 | 8/1977 | Güell | 66/219 |
| 4,793,159 | 12/1988 | Sawazaki | 66/220 |

FOREIGN PATENT DOCUMENTS

| | | | |
|---|---|---|---|
| 0479371 | 4/1992 | European Pat. Off. | 66/219 |
| 3542178 | 6/1987 | Germany | 66/38 |
| 1565948 | 4/1980 | United Kingdom . | |

*Primary Examiner*—Clifford D. Crowder
*Assistant Examiner*—John J. Calvert
*Attorney, Agent, or Firm*—Bell, Seltzer, Park & Gibson

[57] ABSTRACT

A circular interlock knitting machine of the interlock butting type including jacquard knitting includes a rotating cylinder having cylinder needles movable between welt, tuck and knit positions, dial needles movable between welt and knit positions along paths of travel which intersect the paths of the cylinder needles, and a needle selection and operating mechanism for the cylinder needles which prevents collision between cylinder and dial needles including an intermediate jack beneath each cylinder needle, a lower jack beneath each intermediate jack, the lower jacks being selectively movable between operative and non-operative positions, lower jack raising cam means for raising the lower jacks in the operative position from the bottom position to the welt position, intermediate jack raising cam means selectively movable between operating and non-operating positions for engaging, when in operating position, and raising from the welt position to the tuck position only those intermediate jacks raised by the selected lower jacks beneath cylinder needles which will not collide with dial needles being moved to the knit position.

15 Claims, 8 Drawing Sheets

TWO COLOR JACQUARD PATTERN

● --- BLACK YARN

○ --- WHITE YARN

ϱ --- KNITTING

H --- DENOTES HIGH-BUTT NEEDLES OR HIGH-BUTT INTERMEDIATE NEEDLES

L --- DENOTES LOW-BUTT NEEDLES OR LOW-BUTT INTERMEDIATE NEEDLES

INTERLOCK KNITTING MACHINE FOR JACQUARD KNITTING

FIELD OF THE INVENTION

This invention relates to circular knitting machines and more particularly circular knitting machines of the interlock type for jacquard knitting.

BACKGROUND OF THE INVENTION

Circular knitting machines of the interlock type have a rotating cylinder with grooves around the periphery thereof and cylinder needles disposed in these grooves for vertical movement therein. Such interlock knitting machines further have a rotating dial having radial grooves therein and dial needles disposed in these grooves for longitudinal mechanical movement.

There are two types of positional relationship of the dial needles and cylinder needles in conventional circular interlock knitting machines. One of these two types is referred to as rib butting and, in this type, the dial needles and cylinder needles are alternately arranged such that the dial needles' path of travel does not intersect the path of travel of the cylinder needles or vice versa. The other of these two types is referred to as interlock butting and, in this type, the dial needles and cylinder needles are arranged in completely confronting positions with their respective paths of travel intersecting.

In jacquard knitting with the rib butting type of interlock circular knitting machines, the heads of the cylinder needles selected for movement to the knitting or tucking positions will not collide with the heads of dial needles also selected for movement to the knitting positions because the cylinder and dial needles will move past each other. Needle collision is therefore not a problem in jacquard knitting on interlock circular knitting machines of the rib butting type.

However, needle collision is a distinct problem in jacquard knitting on interlock circular knitting machines of the interlock butting type. Accordingly, jacquard knitting on interlock circular knitting machines has heretofore been restricted to such machines of the rib butting type. Jacquard knitting on interlock machines of the rib butting type has several disadvantages and deficiencies. For example, such jacquard fabrics frequently have a see-through characteristic which permits under-yarn loops on the back of the fabric to be seen from the front between the yarn loops forming the face of the fabric. Further, with such rib butting type of interlock machine, a laterally-striped pattern will frequently exhibit a wave effect in the lateral stripes. Still further, fabric flexibility is limited.

SUMMARY OF THE INVENTION

With the foregoing in mind, it is an object of the present invention to provide an interlock circular knitting machine of the interlock butting type which can perform jacquard knitting in a highly safe manner free from collision between cylinder needles and dial needles.

This object is accomplished in the interlock circular knitting machine of the present invention by a needle selection and operating mechanism which selects and operates cylinder needles and dial needles in such a manner that collision between the heads of such needles is obviated even in the most intricate patterns of jacquard knitting. In accordance with the present invention, two dial needles having at least two types of butts are disposed in each groove in the dial. The needle selection and operating mechanism has dial cams providing a plurality of cam tracks which control the plurality of types of butts on the dial needles and operate to move selectively the dial needles in the dial grooves to the knitting position.

A cylinder needle is disposed in each cylinder groove for movement in a path of travel which intersects the path of travel of the dial needles. The needle selection and operating mechanism of the present invention includes two types of lower jacks and two types of intermediate jacks positioned alternately in the cylinder grooves beneath the cylinder needles. The lower jacks have a plurality of armatures and the intermediate jacks have a plurality of butts, with the lower and intermediate jacks of the same type of armature and butt being combined or in vertical alignment.

The needle selection mechanism includes at least one lower electromagnet for selecting particular lower jacks for selected cylinder needles and a lower jack cam for raising the lower jacks from the bottom position to the welt position. Intermediate jack operating cams, including intermediate jack raising cams selectively move from operating and non-operating positions, raise selected intermediate jacks from the welt position to the tuck position. Needle cams are provided to move cylinder needles raised to the tuck position to the knitting position if the pattern dictates such movement. Otherwise, the cylinder needle will remain at the tucking position.

Even if wrong needle selection is made, as frequently occurs for one reason or another, the lower jacks wrongfully selected can move only from the bottom to the welting position. The intermediate jack cam system includes an upper guard cam and a lower guard cam and an intermediate jack raising cam that is selectable for operating or non-operating position. The intermediate jack raising cam for the wrongfully selected needle will be in the non-operating position and will not engage the butt of the intermediate jack moved upwardly by the wrongfully selected lower jack and will not move the intermediate jack further upward beyond the welting position. Similarly, the needle raising cam will not engage the butt of the cylinder needle and will not move the cylinder needle above the welting position. Therefore all possibility of needle collision is obviated.

In the drawings and specifications, there has been set forth a preferred embodiment of the invention, and although specific terms are employed, they are used in generic and descriptive sense only and not for purpose of limitation.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE ILLUSTRATED EMBODIMENT

Figure 1:
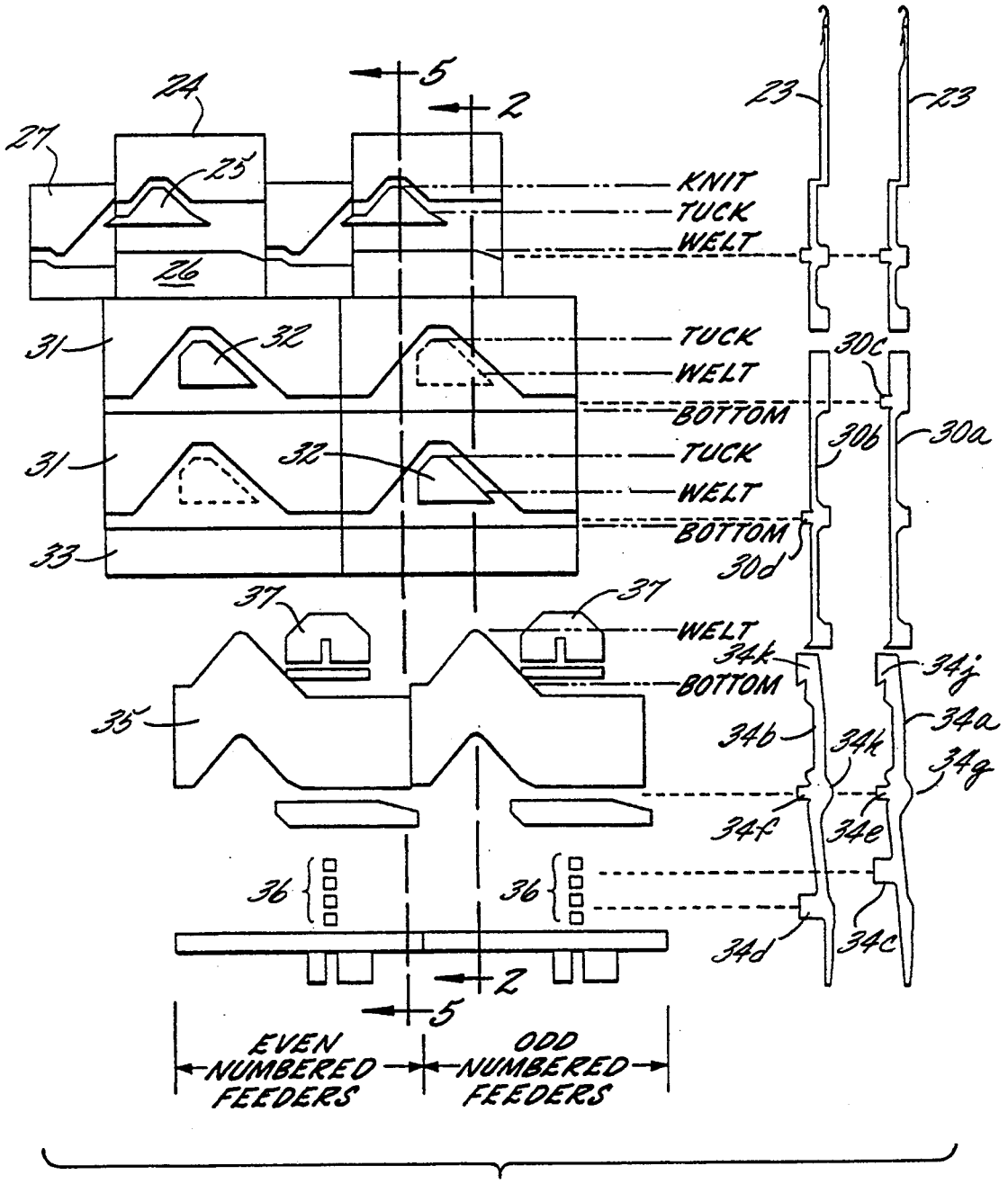
FIG. 1 is a schematic developed elevational view of the cylinder needles, intermediate and lower jacks, cams and needle selection units in accordance with the present invention.

Referring more specifically to the drawings, there is illustrated a circular interlock knitting machine generally indicated at 20. Circular knitting machine 20 is of the interlock butting type and includes a rotating cylinder 21 and a rotating dial 22.

Cylinder grooves are provided in the outer periphery of cylinder 21 and a single cylinder needle 21 is positioned in each cylinder groove. The cylinder needles 23 slide upwardly and downwardly in the cylinder grooves by operation of cylinder needle operating cams 24, 25, 26 and 27 (FIGS. 1 and 2) between welt, tuck and knit positions, illustrated and labeled in FIG. 1.

Two types of intermediate jacks 30*a*, 30*b* are alternately positioned in the cylinder grooves of cylinder 21 under the cylinder needles 23. The two types of intermediate jacks 30*a*, 30*b* differ only in the height of butts 30*c* and 30*d* thereon. Butt 30*c* is referred to as a high butt and butt 30*d* is referred to as a low butt.

Intermediate jacks 30*a*, 30*b* slide upwardly and downwardly in the cylinder grooves by operation of dual-race cams 31, 32 and 33 between bottom, welt and tuck positions (FIG. 1). The intermediate jack raising cam 32 is selectable for operating and non-operating positions in accordance with the needle selection pattern. Further, the intermediate jack raising cam 32 is selected for and set at the operating or non-operating position with respect to each of the two races thereof. The solid and dotted lines denote the operating and non-operating positions respectively in FIG. 1.

Two types of lower jacks 34*a*, 34*b* are alternately positioned in the cylinder grooves beneath the intermediate jacks 30*a*, 30*b*. Lower jacks 34*a* are positioned in the cylinder grooves in which intermediate jacks 30*a* are positioned and lower jacks 34*b* are positioned beneath intermediate jacks 30*b*. Lower jacks 34*a*, 34*b* differ in the height of armatures 34*c*, 34*d* thereon. Armature 34*c* is referred to as a high armature and armature 34*d* is referred to as a low armature. Lower jacks 34*a*, 34*b* are slidable upwardly and downwardly in the cylinder grooves by operation of butts 34*e*, 34*f* thereon and lower jack raising cam 35 between bottom and welt positions only.

Preferably, lower jacks 34*a*, 34*b* are rocking jacks in that they are pivotable in the cylinder grooves with rounded medial sections 34*g*, 34*h* as a fulcrum. Also, lower jacks 34*a*, 34*b* have upper armatures 34*j*, 34*k* at the upper ends thereof.

The needle selection mechanism of the present invention includes electromagnets 36, 37 which co-act, respectively, with armatures 34*c*, 34*d* and 34*j*, 34*k* to rock lower jacks 34*a*, 34*b* about the fulcrums 34*g*, 34*h*. For a more detailed description of electromagnetic needle selection, reference is made to U.S. Pat. No. 4,793,159, issued Dec. 27, 1988 and owned by the assignee of this application.

Figure 2:
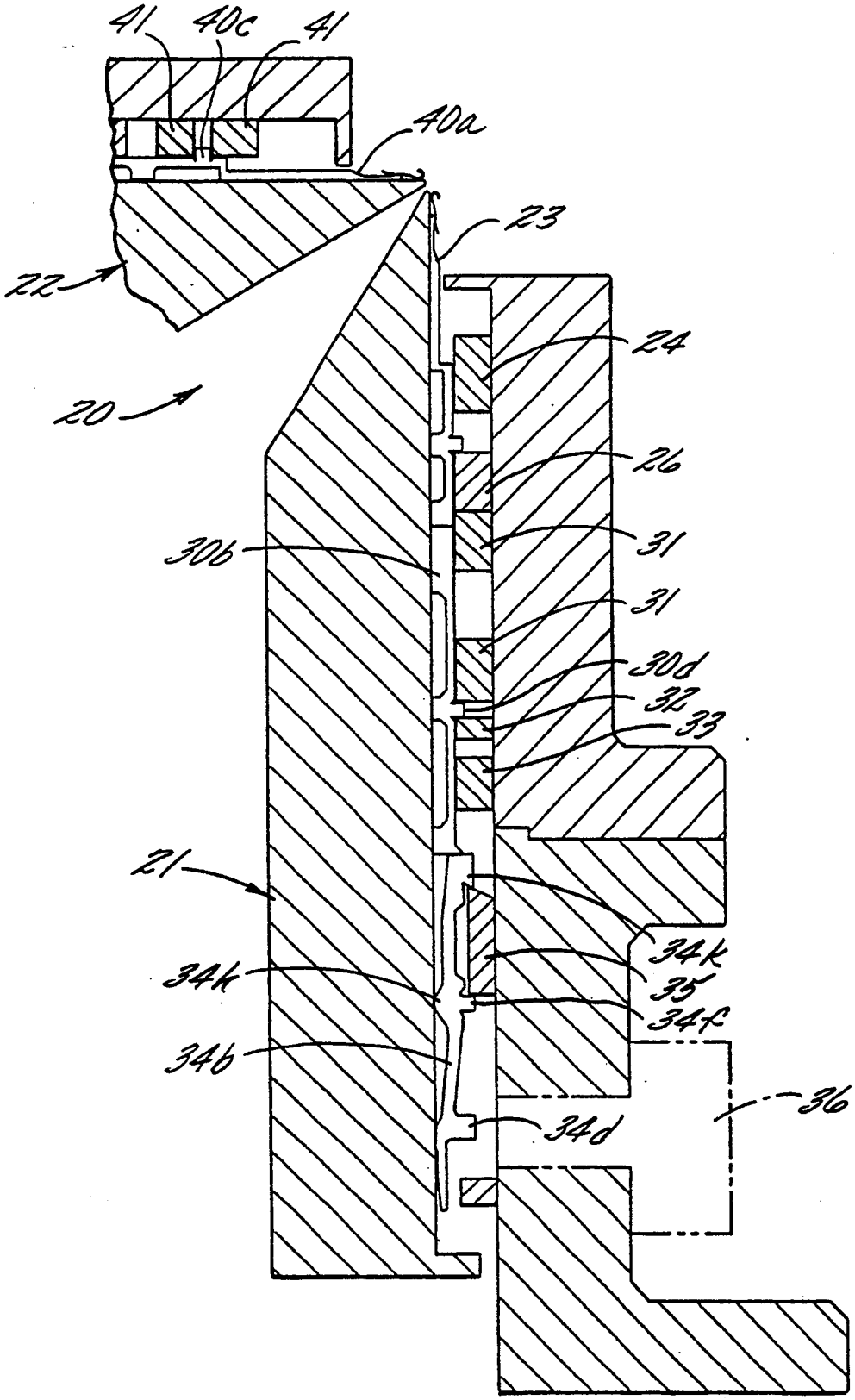
FIG. 2 is an enlarged fragmentary sectional view taken substantially along line 2—2 in FIG. 1 showing low-butt lower and intermediate jack selection.
Figure 3:
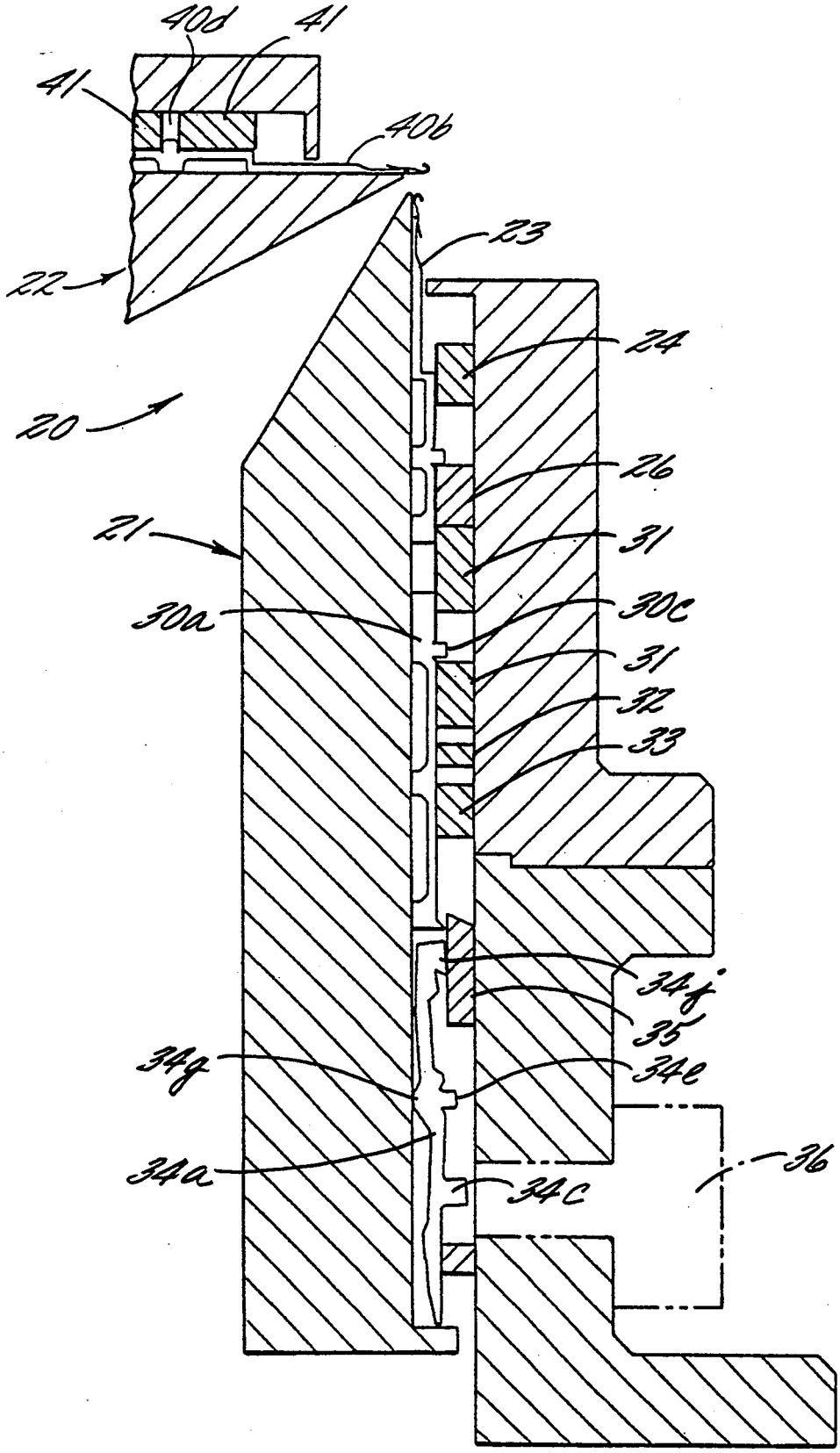
FIG. 3 is a view similar to FIG. 2 showing high-butt lower and intermediate jack selection.

Dial grooves are provided in dial 22 of interlock knitting machine 20 and two types of dial needles 40*a*, 40*b* are positioned in each dial groove. The dial needles 40*a*, 40*b* differ in the position of butts 40*c*, 40*d* (FIGS. 2 and 3). Butt 40*c* is referred to as a high butt and butt 40*d* is referred to as a low butt. Dial needles 40*a*, 40*b* selectively slide back and forth in the dial grooves by operation of dual-race dial needle operating cams 41 coacting with the butts 40*c*, 40*d* on dial needles 40, 40*b* between welt, tuck and knit positions.

Dial operating cam 41 is selectable for operating or non-operating positions in accordance with the needle selection pattern. When in operating position, dial operating cam 41 will move dial needles 40*a*, 40*b* selectively to tuck or knit positions from the welt position. When in non-operating position, dial operating cam 41 will maintain the dial needles 40*a*, 40*b* in the welt position.

As illustrated, only the low-butt intermediate jacks 30*b* are selected with the odd-numbered yarn feeders to move cylinder needles 23 to the tuck or knit positions (FIGS. 2 and 8) and the high-butt intermediate jacks 30*a* will maintain their corresponding needles 23 in the welt position. With even-numbered yarn feeders, only the high-butt intermediate jacks 30*a* are selected to move cylinder needles 23 to the tuck or knit position (FIGS. 3 and 8) while the low-butt intermediate jacks 30*b* maintain their corresponding needles 23 in the welt position.

Similarly, dial cam 41 is selected to move the low-butt dial needles 40*b* to the knit position with the odd-numbered yarn feeders (FIGS. 3 and 8) while maintaining the high-butt dial needles 40*a* in the welt position. With the even-numbered yarn feeders, the high-butt dial needles 40*a* are moved to the knit position by dial cam 41 while the low-butt needles 40*b* are maintained in the welt position.

Figure 4:
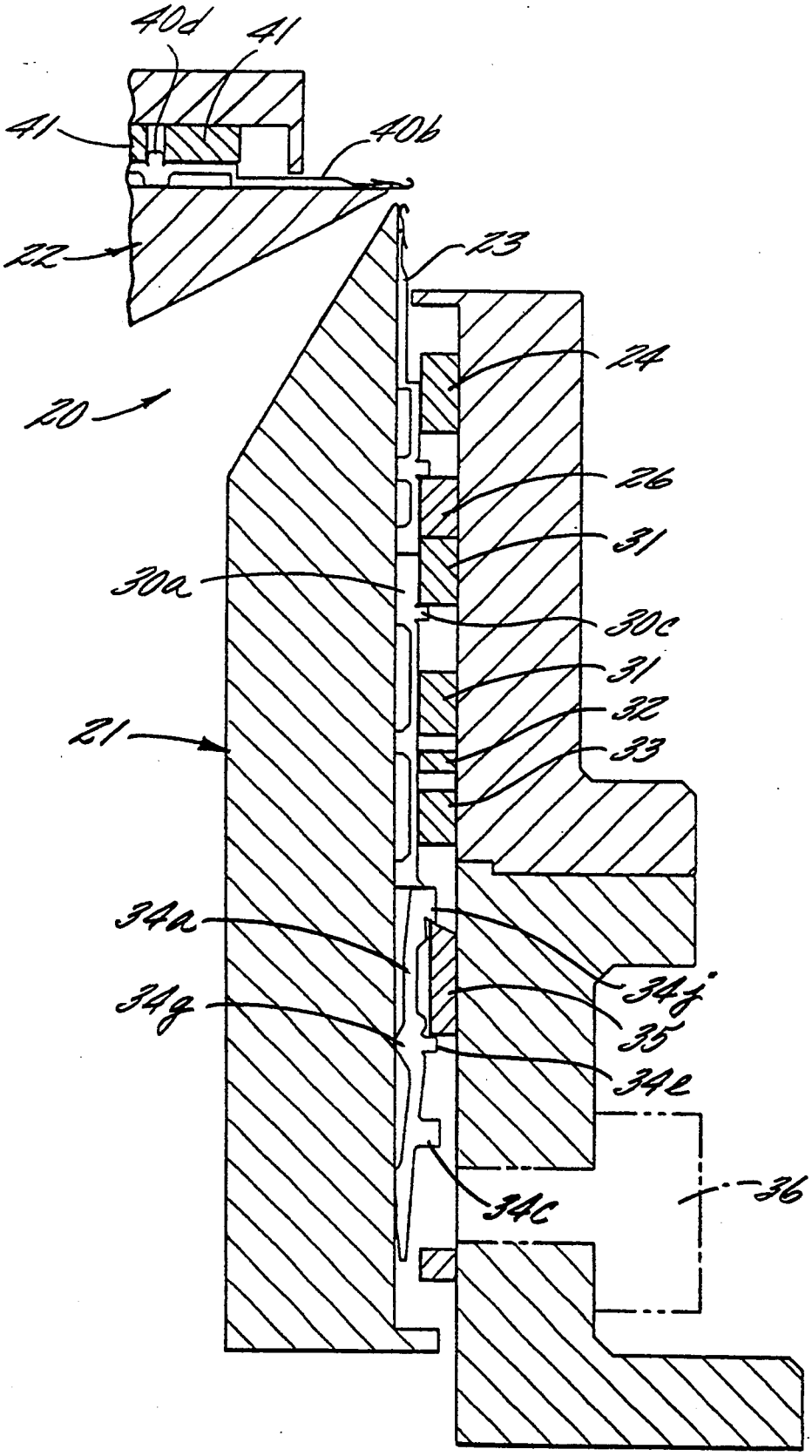
FIG. 4 is a view similar to FIG. 2 illustrating wrongful selection of a lower jack having a high-armature.
Figure 6:
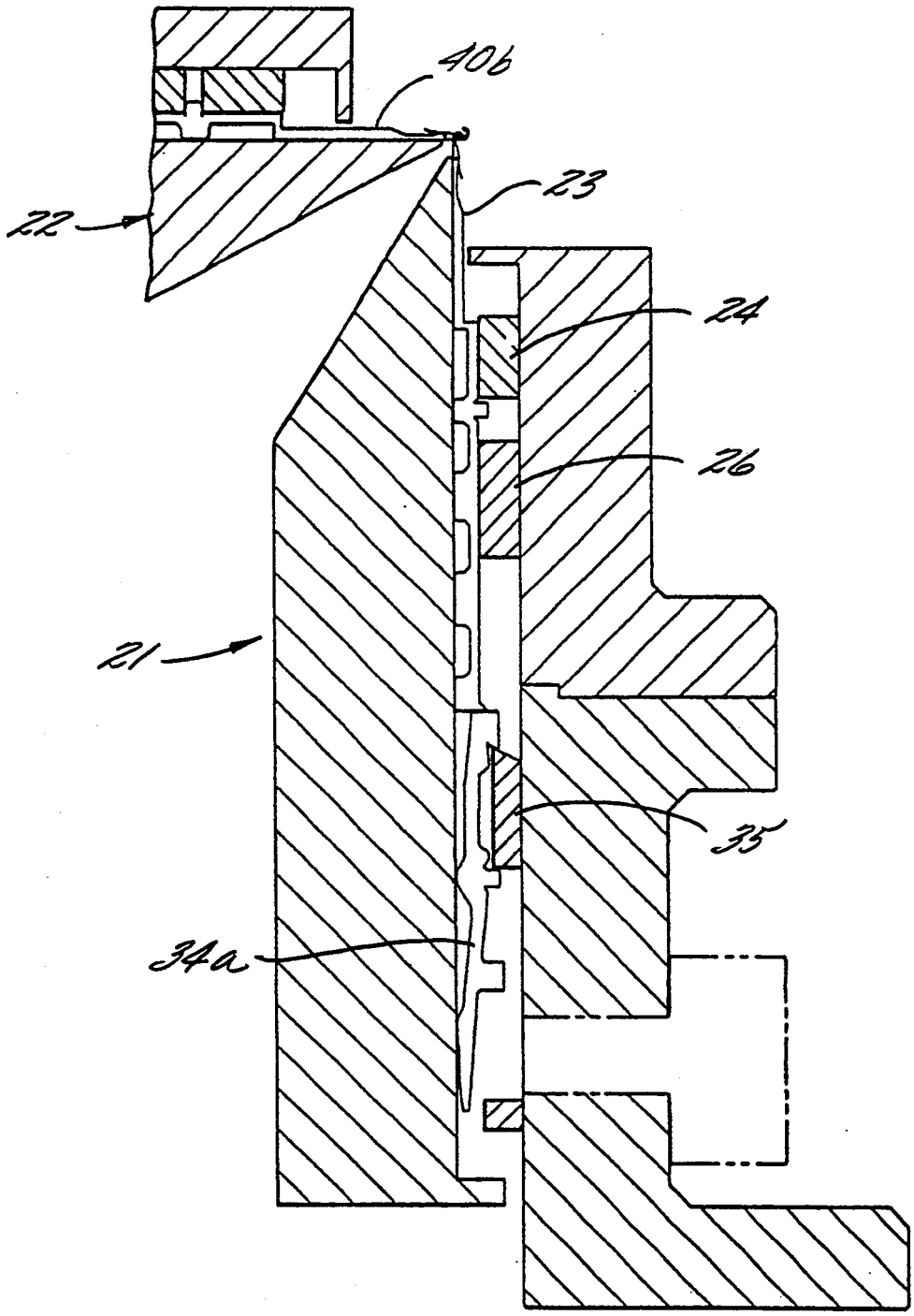
Fig. 6. (PRIOR ART)
FIG. 6 is a view similar to FIG. 5 showing wrongful cylinder needle selection by a lower jack having a high-armature in the prior art.

Referring now to FIGS. 4 and 6, there is illustrated a condition where lower jacks 34*a* having high armatures 34*c* have been wrongfully selected. Heretofore such wrongful selection would have caused the lower jacks to move their corresponding needles 23 upwardly into the path of dial needles 40*b* causing the heads thereof to collide (FIG. 6). However, as illustrated in FIG. 4, the needle selection and operating mechanism of the present invention prevents such collisions because the intermediate jack raising cam 32 is set in the non-operating position and will not engage and raise the intermediate jack 30*a*. Accordingly, intermediate jack 30*a* will maintain the welting position and will not raise its corresponding cylinder needle 23 into the path of the dial needle 40*b* even if the dial needle 40*b* is moved to the tuck or knit position.

The lower jack 34*a* in FIG. 4 is moved only as far as the welting position, whereas, in FIG. 6, prior needle selection and operating mechanisms would have moved the lower jack 34*a* up to the tuck or knit positions and the lower jack would move the cylinder needle therewith. In FIG. 4, even if the lower jack 34*a* is wrongfully selected, collision between cylinder and dial needles is prevented because intermediate jack raising cam 32 is in the non-operative position and lower jack 34*a* does not move upwardly far enough to move cylinder needle 23 into the path of dial needle 4O*b*.

The operation of the needle selection and operating mechanism of the present invention will now be described for needle selection for each of the welting, knitting and tucking positions. For those cylinder needles 23 which are selected to be maintained in the welt or welting position, the lower jacks 34*a*, 34*b* have the armatures 34*c*, 34*d* thereof attracted to the electromagnet 36. This rocks the lower jacks in a clockwise direction as seen in FIG. 1 and moves the tops thereof out of the path of lower jack raising cam 35, as seen in FIG. 3. Lower jacks 34*a*, 34*b* therefore remain in the bottom position and move circumferentially around with cylinder 21 as it rotates.

Since lower jacks 34*a*, 34*b* do not raise intermediate jacks 30*a*, 30*b*, the butts 30*c*, 30*d* thereof move along the bottom positions of intermediate jack guard cam 31. Intermediate jacks 30*a*, 30*b* also move circumferentially as cylinder 21 rotates. Cylinder needles 23 move along the welt or welting position of lower guard cam 26 and also along the lower section of stitch cam 27 as cylinder 21 rotates. In this operating state, the lower jacks 34*a*, 34*b* are not in contact with the intermediate jacks 30*a*, 30*b* and intermediate jacks 30*a*, 30*b* are not in contact with cylinder needles 23.

When lower jacks 34*a*, 34*b* are to be selected for cylinder needles 23 to move to the knit or knitting position, electromagnet 37 is energized and attracts the armatures 34*j*, 34*k* at the top of lower jacks 34*a*, 34*b*. The tops of lower jacks 34*a*, 34*b* are thereby moved counter-clockwise as seen in FIG. 1 into the path of lower jack raising cam 35, as is illustrated in FIG. 2. Cam 35 raises the lower jacks 34*a*, 34*b* to the welt or welting position and will thereby raise the intermediate jacks 30*a*, 30*b* to the welt position (FIG. 2).

The intermediate jack raising cam 32 is in the operative position and the butts 30*a*, 30*d* of intermediate jacks 30*a*, 30*b* engage cam 32 and move along the top surface thereof. Cam 32 thusly raises the intermediate jacks 30*a*, 30*b* from the welt position to the tuck position, and intermediate jacks 30*a*, 30*b* raise cylinder needles 23 to the tuck position.

Figure 5:
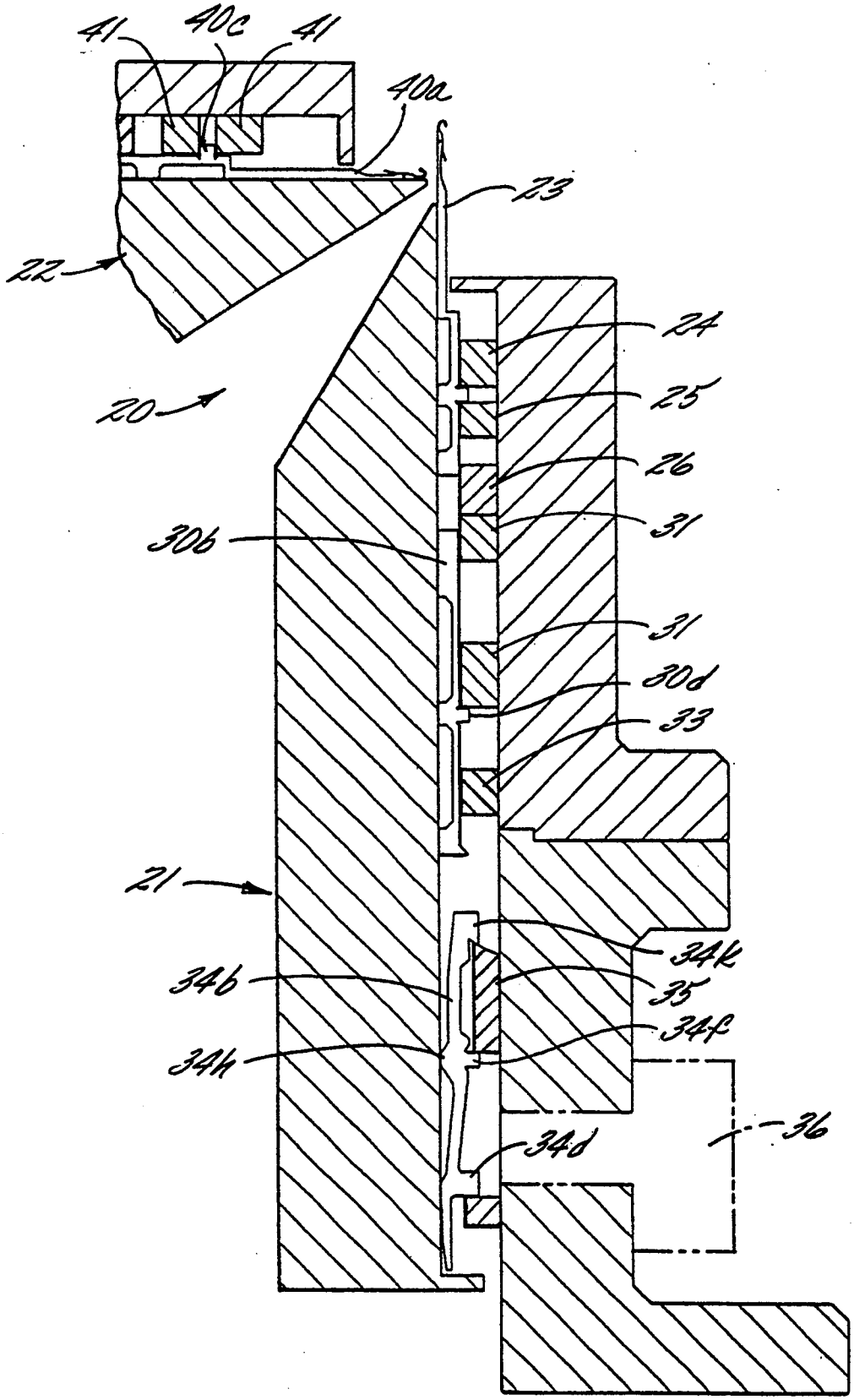
FIG. 5 is an enlarged fragmentary sectional view taken substantially along line 5—5 in FIG. 1 showing low-butt jack selection.

The butts of the cylinder needles 23 will then engage the needle raising cam 25, which is in the operating position, and will move along the top surface thereof. Cam 25 will thereby raise cylinder needles 23 from the tuck position to the knit position (FIG. 5).

When cylinder needles 23 are selected to be moved to the tuck position, the selection and operation of the lower jacks 34*a*, 34*b* and intermediate jacks 30*a*, 3O*b* are the same as described above for movement of needles 23 to the knit position. Needle raising cam 25 will be in the non-operating position and the butts of cylinder needles 23 will not engage the top surface of cam 25, but needles 23 will remain in the tuck position to which they were moved by intermediate jacks 30*a*, 30*b*.

Figure 7:
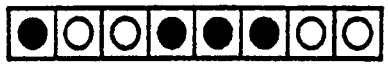
FIG. 7 is a schematic view of a jacquard pattern to be knitted using the needle selection mechanism of the present invention.
Figure 8:
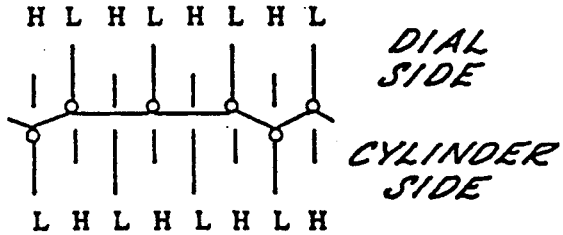
FIG. 8 is a schematic view of an arrangement of cylinder needles and dial needles and illustrating a knitting method of a jacquard pattern.
Figure 8:
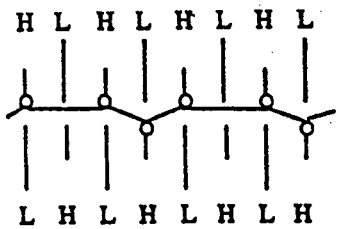
Figure 8:
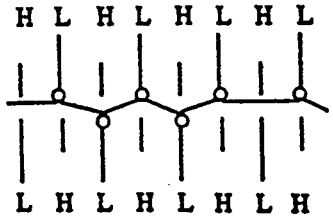
Figure 8:
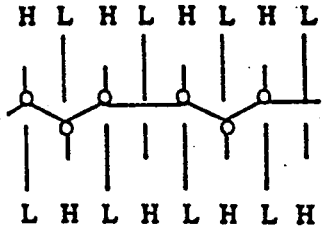

An exemplary jacquard pattern utilizing black and white yarns is shown in FIG. 7. This pattern is knit using a needle selection pattern and yarn feeding arrangement similar to that shown in FIG. 8. In this pattern, white yarns are fed at the first and fourth yarn feeders while black yarns are fed at the second and third yarn feeders. In FIG. 8, "H" indicates high-butt dial needles 40*a* or high-butt intermediate jacks 30*a*, and "L" indicates low-butt dial needles 40*b* or low-butt intermediate jacks 30*b*.

In the odd-numbered yarn feeders (first and third), only the low-butt dial needles 40*b* and low-butt intermediate jacks 30*b* are selected for knitting and all of the high-butt dial needles 40*a* and high-butt intermediate jacks 30*a* are to be maintained in the welt positions. In the even-numbered yarn feeders (second and fourth), only the high-butt dial needles 40*a* and high-butt intermediate jacks 30*a* are selected for knitting and all of the low-butt dial needles 40*b* and low-butt intermediate jacks 30*b* are maintained in the welt positions.

While the example shown only illustrates needle selection for knitting, needle selection for tucking is also possible. Additionally, the needle selection made may be changed in the odd-numbered or even-numbered yarn feeders.

Figure 9:
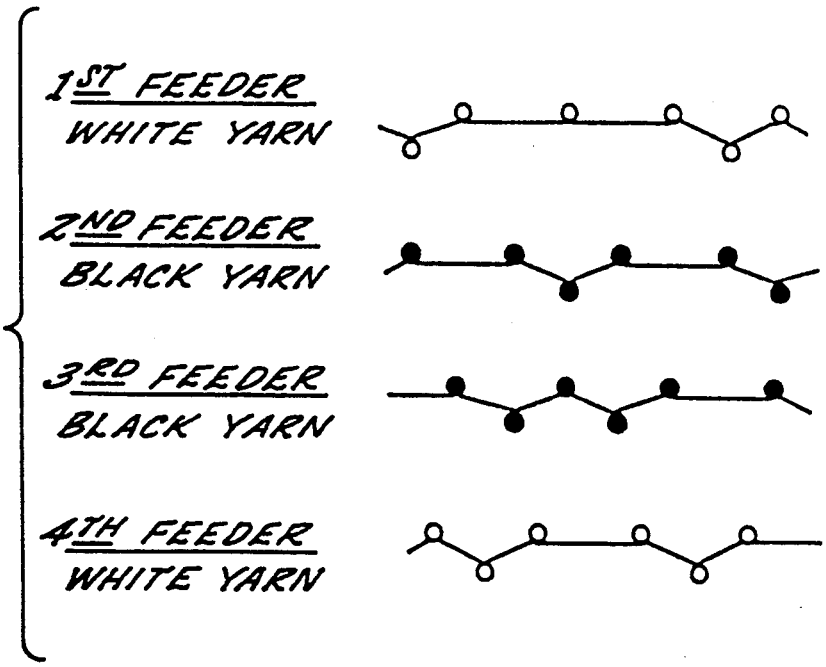
FIG. 9 is a schematic view illustrating loops formed at each yarn feeder by the knitting method illustrating in FIG. 8.
Figure 10:
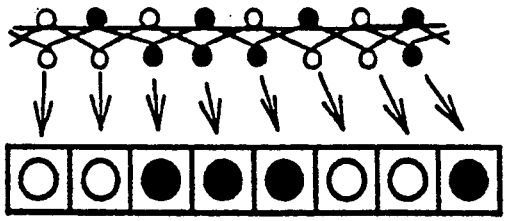
FIG. 10 is a schematic view of a composite of the loops formed at all yarn feeders illustrated separately in FIG. 9.

Each of the cylinder needles 23 and dial needles 40*a*, 40*b* selected for knitting form loops at each yarn feeder as shown in FIG. 9. The loops knitted in these four yarn feeders overlap with each other and form a jacquard pattern as shown in FIG. 10.

In the drawings and specifications, there has been set forth a preferred embodiment of the invention, and although specific terms are employed, they are used in generic and descriptive sense only and not for purpose of limitation.

What is claimed is:

1. In a circular interlock knitting machine for jacquard knitting having a cylinder with vertical grooves therein, a cylinder needle slidably mounted in each of the cylinder grooves for movement between welt, tuck and knit positions, intermediate and lower jacks slidably mounted in each cylinder groove beneath said cylinder needle, a dial operatively associated with said cylinder and having dial grooves extending radially in one side thereof, at least one dial needle slidably mounted in each dial groove for movement between welt and knit positions along paths of travel which intersect the paths of travel of said cylinder needles, dial needle operating cam means for selectively moving certain of said dial needles from the welt position to the knit position, the combination therewith of cylinder needle selection and operating means for selecting certain of said cylinder needles for movement from the welt position to the knit or tuck positions while avoiding any collision of said cylinder needles with said dial needles, said needle selection and operating means comprising (a) lower jack raising cam means for raising selected lower jacks from a bottom position to the welt position, (b) means for selectively moving the lower jacks in the cylinder grooves containing the cylinder needles selected for movement to the knit or tuck positions into the path of said lower jack raising cam means so that said selected lower jacks are raised from the bottom position to the welt position and said selected lower jacks raise corresponding intermediate jacks from a bottom position to the welt position, and (c) intermediate jack raising cam means selectively movable between operating and non-operating positions responsive to the selection of said dial needles and said cylinder needles for movement from the welt positions to the knit or tuck positions for raising from the welt position to the tuck position only those intermediate jacks beneath cylinder needles which will not collide with dial needles which have been selected for movement to the knit position.

2. An interlock knitting machine according to claim 1 wherein said means for selectively moving certain lower jacks comprises spaced apart armatures on said lower jacks and spaced electromagnets for selectively attracting said armatures to move said lower jacks to operative or non-operative positions.

3. An interlock knitting machine according to claim 2 wherein said lower jacks are mounted for pivotal or rocking movement in said cylinder grooves about a medially located fulcrum and said spaced armatures are located on opposite sides of said fulcrum.

4. An interlock knitting machine according to claim 1 further including needle raising cam means selectively movable between operating and non-operating positions responsive to the selection of said dial needles and said cylinder needles for movement to the knit or tuck positions for engaging and moving from the tuck position to the knit position only those cylinder needles which will not collide with dial needles which are being moved to the knit position.

5. An interlock knitting machine according to claim 1 wherein said intermediate jack cam means include intermediate jack raising cams selectively movable between operating and non-operating positions and upper guard cams and lower guard cams which maintain said intermediate jacks in the welt position when said intermediate jack raising cams are in the non-operating position.

6. An interlock knitting machine according to claim 4 wherein said cylinder needle cam means includes cylinder needle raising cams selectively movable between operating and non-operating positions, upper guard cams and lower guard cams for maintaining said cylinder needles in the tuck position when said cylinder needle raising cams are in the non-operating position, and stitch cams for causing said needles to form loops.

7. An interlock knitting machine according to claim 1 wherein a pair of dial needles are mounted in each dial groove, one of which has a high butt and the other of which has a low butt, and wherein said dial needle operating cam means comprises a dual-race cam operatively associated with said high and low butts of said dial needles.

8. A needle selection and operating apparatus for a circular interlock knitting machine of the interlock butting type having cylinder needles and dial needles movable along intersecting paths of travel, said needle selection and operating apparatus being characterized in that collisions between cylinder needles and dial needles is prevented even if a cylinder needle is wrongfully selected, said needle selection and operating apparatus comprising an intermediate jack adapted to be mounted beneath each cylinder needle for raising the cylinder needle from a welt position to a tuck position, a lower jack mounted beneath said intermediate jack for movement longitudinally to raise said intermediate jack from a bottom position to the welt position, said lower jack being movable between operative and non-operative positions, lower jack raising cam means for raising said lower jacks in the operative position from a bottom position only to the welt position, lower jack selection means for selectively moving certain of said lower jacks to the operative position and the remainder of said lower jacks to the inoperative position, and intermediate jack raising cam means selectively movable between operating and non-operating positions for engaging and raising from the welt position to the tuck position only those intermediate jacks of said intermediate jacks raised by said lower jacks beneath cylinder needles which will not collide with dial needles being moved to the knit position.

9. A needle selection and operating apparatus according to claim 8 wherein said lower jacks are mounted for rocking movement about a medial fulcrum and have spaced apart armatures on opposite sides of the fulcrum, and including spaced apart electromagnets for selectively attracting said armatures to move said lower jacks between operative and non-operative positions.

10. A needle selection and operating apparatus according to claim 9 wherein said armatures on the lower portions of said lower jacks are at different positions on alternate and intervening lower jacks.

11. A needle selection and operating apparatus according to claim 10 wherein said armatures on the lower portions of alternate lower jacks are low armatures and said armatures on the lower portions of intervening lower jacks are high armatures, the low armatures being spaced further from the fulcrums than the high armatures.

12. A needle selection and operating apparatus according to claim 8 wherein said intermediate jack raising cam means include intermediate jack raising cams selectively movable between operating and non-operating positions, and upper and lower guard cams maintaining said intermediate jacks in the welt position when said intermediate jack raising cams are in the non-operating position.

13. A needle selection and operating apparatus according to claim 12 wherein said intermediate jacks have butts therein engageable with said intermediate jack raising cams when said cams are in the operating position so that said intermediate jack raising cams raise said selected intermediate jacks from the welt position to the tuck position.

14. A needle selection and operating apparatus according to claim 13 wherein said butts on said intermediate jacks are at different positions on alternate and intervening intermediate jacks.

15. A needle selection and operating apparatus according to claim 8 including cylinder needle raising cam means selectively movable between operating and non-operating positions and when in operating position for engaging cylinder needles raised by said intermediate jacks to the tuck position for moving these cylinder needles from the tuck position to the knit position.

* * * * *